United States Patent [19]

Schaltegger

[11] Patent Number: 4,625,775

[45] Date of Patent: Dec. 2, 1986

[54] HIGH SPEED CONTAINER PLACEMENT APPARATUS

[76] Inventor: Herbert E. Schaltegger, 10 Schaghticoke Trail, New Milford, Conn. 06776

[21] Appl. No.: 716,680

[22] Filed: Mar. 27, 1985

[51] Int. Cl.[4] ..... B65B 1/04

[52] U.S. Cl. ..... 141/83; 141/168; 74/393; 198/504; 198/474.1; 198/343

[58] Field of Search ..... 198/504, 505, 474.1, 198/475.1, 343; 74/393; 141/129-191, 98, 83

[56] References Cited

U.S. PATENT DOCUMENTS

| | | | |
|---|---|---|---|
| 2,860,760 | 6/1955 | Yeo et al. | 198/24 |
| 2,931,276 | 4/1960 | Zerlin | 198/474.1 |
| 3,978,968 | 9/1976 | Rose et al. | 198/339 |
| 4,168,773 | 9/1979 | Thiel et al. | 198/479 |
| 4,275,807 | 6/1981 | Mohn et al. | 198/474.1 |
| 4,450,950 | 5/1984 | Foote, Jr. | 198/474.1 |
| 4,456,114 | 6/1984 | Mohn | 198/474.1 |

*Primary Examiner*—Houston S. Bell, Jr.
*Attorney, Agent, or Firm*—Cifelli, Frederick & Tully

[57] ABSTRACT

A high speed container placement apparatus is provided for use in combination with a high speed filling equipment for consumer products, such as instant coffee. A container separating device introduces groups of containers to a container placement and removal device for sequencing therethrough. The individual members of a group are transferred from a high speed annular turntable of the container placement and removal device to separate stationary work positions on a deck plate where they undergo a processing step such as filling the container by weight with an appropriate amount of product. Following this processing step, the containers are removed from their respective stationary work positions and returned to the high speed annular turntable to be ultimately discharge from the container placement and removal device. Simultaneously, the next group of containers is fed into the apparatus to replace the fully processed group.

27 Claims, 35 Drawing Figures

16
52
90
87
C8
48
103
42
104
135
50
94
120
124
C1
46
40
80
44
32
C1

HIGH SPEED CONTAINER PLACEMENT APPARATUS

BACKGROUND OF THE INVENTION

The present invention relates generally to high speed container placement apparatus and more particularly to a high speed container apparatus for use in combination with filling equipment to achieve accurate net weight product filling of the containers.

Government regulations require that the average actual net weight of package or containerized consumer products, such as instant coffee, be equal to or above the labelled net weight of the products. To keep abreast of the demand for their products, manufacturers must utilize high speed filling machines which move the containers at constant speeds. Since only volumetric dispensing devices can be used to fill moving containers and the labelled net weight must be close to the actual net weight even when the dispensed volume or the product density are at their lowest levels, the manufacturers often overfill containers with considerable amounts of product as fluctuations in the density of the product and the dispensing volumes occur.

To eliminate such inaccuracies, the product should be dispensed by weight into the containers; however, accurate weighing requires a low rate of product flow which, in turn, requires long filling cycles. Ideally, to keep the length of filling time to a minimum, the containers can be first underfilled with the bulk of a product from a volumetric filling machine. Thereafter, these underfilled containers can be topped off with a small amount of product to bring the actual net weight to the labelled net weight in fairly short time cycle, e.g., under two seconds, utilizing low product flow in a machine dispensing by weight.

Since weight dispensing devices cannot travel at high speeds and maintain their accuracy utilizing the desirable low product flow rate, it is necessary to perform the top-off dispensing operation from the stationary dispensing devices. This permits an unimpeded flow of product into the stationary dispensing device as well as accurate weight control. With the containers travelling at a desired line speed, the containers must be decelerated to a stop underneath the dispensing device for the period of time necessary for the filling operation to be performed at a low rate of product flow and accelerated to restore them to their normal rate of line speed.

The conventional means employed to perform these deceleration/acceleration steps utilizes a reciprocating mechanism to position the containers under stationary dispensing devices and return them to the conveyor line. However, these mechanisms are incapable of operating in connection with the high line speeds, even if they handle several containers simultaneously, since the mechanisms are large, bulky and require several time-consuming movements for proper positioning and removal of the containers in relation to the dispensing devices.

It is an object of the present invention to provide a novel container placement device for use in conjunction with filling devices which dispense product within a very close tolerance of a desired weight.

A further object is to provide such device which decelerates the containers to a stop from a high line speed for the filling operation and accelerates them afterwards to the full line speed.

It is also an object to automatically handle each container on an individual basis to insure accurate filling by weight thereof.

Still another object is to provide such a device which may be readily fabricated and will enjoy a long life in operation.

SUMMARY OF THE INVENTION

It has now been found that the foregoing and related objects can be readily attained in a high speed container placement apparatus including a plurality of container receiving stations, which can be weigh stations with product dispensing devices for filling the containers by product weight, spaced equidistantly from a central axis, an annular turntable rotatable about the central axis, a pair of conveying devices juxtaposed adjacent the turntable for introducing containers onto the turntable and removing containers therefrom, and a pair of mechanism to guide containers between the turntable and the plurality of container receiving stations, the guide mechanisms including oscillatable discharge and feeder guide members which follow an epicycloidal path around the central axis.

Desirably, the guide mechanisms further include a stationary gear coaxial with the central axis and having external teeth thereon, a main drive shaft journalled for rotation about the central axis, an internal gear mounted on the drive shaft for rotation about a center axis eccentrically spaced from the central axis, the internal gear being positioned around the stationary gear and being in meshing contact therewith, whereby rotation of the drive shaft swings the center axis and the internal gear about the central axis causing the internal gear to rotate around the center axis. The guide mechanisms include lever mechanisms for the feeder and discharge guides rotatably mounted on the internal gear and operatively connected to the stationary gear, whereby rotation of the internal gear around the center axis permits the lever mechanisms to oscillate the feeder and discharge guides as they follow the epicyloidal path.

Ideally, each of the lever mechanisms include a bushing rotatably retained on the internal gear, an upper arm cantilevered from one end of the bushing, and a lower arm extending from the other end of the bushing at an acute angle to the upper arm. The lower arms are operatively connected to the stationary gear by cam rollers captured for movement in a cam track thereby oscillating the lever mechanism as the internal gear rotates around the center axis.

Conveniently, the conveying devices include a container delivery and separating unit for introducing groups of containers onto the annular turntable for placement by the feeder guide onto the receiving stations. The delivery and separating unit includes a timing screw having a helical groove with axially expanding turns for spacing adjacent containers. The delivery and separating units also include a rotatable starwheel adjacent the turntable and a terminal end of the timing screw whereby containers exiting from the timing screw are intercepted by the starwheel and transferred to the turntable.

In the preferred embodiment, an auxiliary discharge device is provided to assist the discharge guide member in guiding the containers from the receiving stations to the turntable. The device has a plurality of container contacting portions adjacent each of the container receiving stations and an actuator associated with the discharge guide to contact individual ones of the contacting portions to assist the discharge guide to transfer an associated container from one of the receiving stations to the turntable. The container contact portions are pivotally mounted adjacent the container receiving stations and have a container contacting arm and an actuator contacting arm extending at an acute angle relative to one another.

The invention will be fully understood when reference is made to the following detailed description taken in conjunction with the accompanying drawings.

DESCRIPTION OF THE PREFERRED EMBODIMENTS

Figure 1:
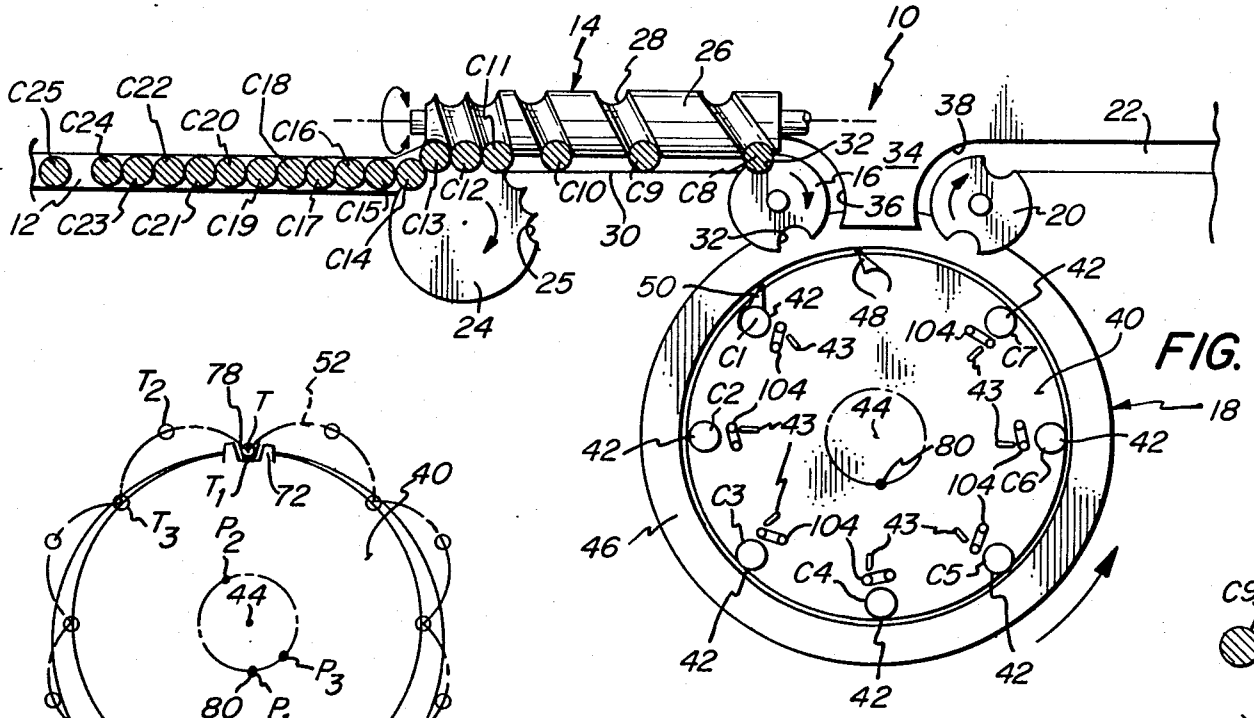
FIG. 1 is a schematic top elevational view of a container placement apparatus embodying the present invention.

Turning first to FIG. 1 of the drawings, therein illustrated is a high speed container placement apparatus embodying the present invention and generally indicated by the numeral 10. The apparatus 10 is comprised of a delivery conveyor 12, a container separating device generally indicated by the numeral 14, a rotatably driven supply starwheel 16, a container placement device generally indicated by numeral 18, a rotatably driven exit starwheel 20, and an exit conveyor 22.

The container apparatus 10 shown in FIG. 1 is in operating sequence with a plurality of containers C1–C25 being sequenced therethrough. Throughout the specification and drawings, the containers will be designated by the letter C; however, designations for specific containers will also include a reference numeral, i.e., container C1, etc. While being sequenced through the apparatus 10, the containers undergo processing or filling; containers which have not undergone processing are illustrated with cross hatched lines.

The delivery conveyor 12, which is of conventional belt or roller driven design, is generally flooded with containers awaiting processing through the container placement device 18. Adjacent the terminal end of the conveyor 12 is the container separating device 14 which permits release of seven containers in succession from conveyor 12 by means of a separating disc 24 rotatably driven in the clockwise direction and having seven cutouts 25 along a portion of its outer periphery for engaging and separating the groups of seven containers. Each group is propelled by the separating disc 24 to a timing screw 26 rotatably driven to space or separate the containers from one another by a desired distance for purposes to be explained hereinafter.

The timing screw 26 is provided with a continuous helical groove 28 along the outer periphery thereof. The pitch of the groove 28 increases along the axial length of the timing screw 26 whereby rotation of the timing screw 26 will separate the individual members of the group of containers to achieve the desired spacing thereof. It is preferred that the timing screw 26 operate in conjunction with a retaining wall 30 which extends parallel to the longitudinal axis of the timing screw 26 and maintains the containers in the groove 28 therein.

Juxtaposed adjacent the righthand end portion of the timing screw 26 is the supply starwheel 16 rotatably driven in the clockwise direction and having a pair of diametrically opposed cutouts 32 for receiving containers from the separating device 14 and transferring them to the container placement device 18. The starwheel 16 cooperates with a deflector 34 having opposed concave surfaces 36 and 38 to guide the containers in an arcuate path along the deflector 34. The operation of the starwheel 16 and the other portions container separating device 14 is controlled by conventional means such as appropriate gearing.

The container placement device 18 is provided with a stationary disc-shaped deck plate 40 having eight positions spaced concentrically around a central axis 44. Seven of these positions are provided with container receiving or weigh stations 42; each spaced a uniform distance from a central axis 44 and shown in FIG. 1 as having one of the containers C1–C7 thereon. It should be noted that the deck plate position on deck plate 40 located between the starwheels 16 and 20 does not have a container receiving station 42 associated therewith. In the preferred embodiment, each of the receiving stations 42 has a dispensing device 43 (see FIGS. 1, 21 and 22) mounted thereabove for purposes to be explained further hereinafter. Mounted concentrically about the deck plate 40 is an annular turntable 46 which is rotatable in the counterclockwise direction about the central axis 44. Mounted for oscillation over the deck plate 40 are feeder guide 48 and discharge guide 50. These guides 48, 50 oscillate as they travel about the deck plate 40 in the epicycloidal path 52 shown in FIG. 2 for purposes and in a manner to be explained further hereinafter.

The rotatably driven exit starwheel 20 is positioned adjacent the annular turntable 46 to intercept containers thereon and move them along arcuate surface 38 to the exit conveyor 22. The exit conveyor 22 is of conventional belt or roller driven design similar to the delivery conveyor 12 and moves the containers away from the container placement device 18 for further packaging or processing.

Figure 21:
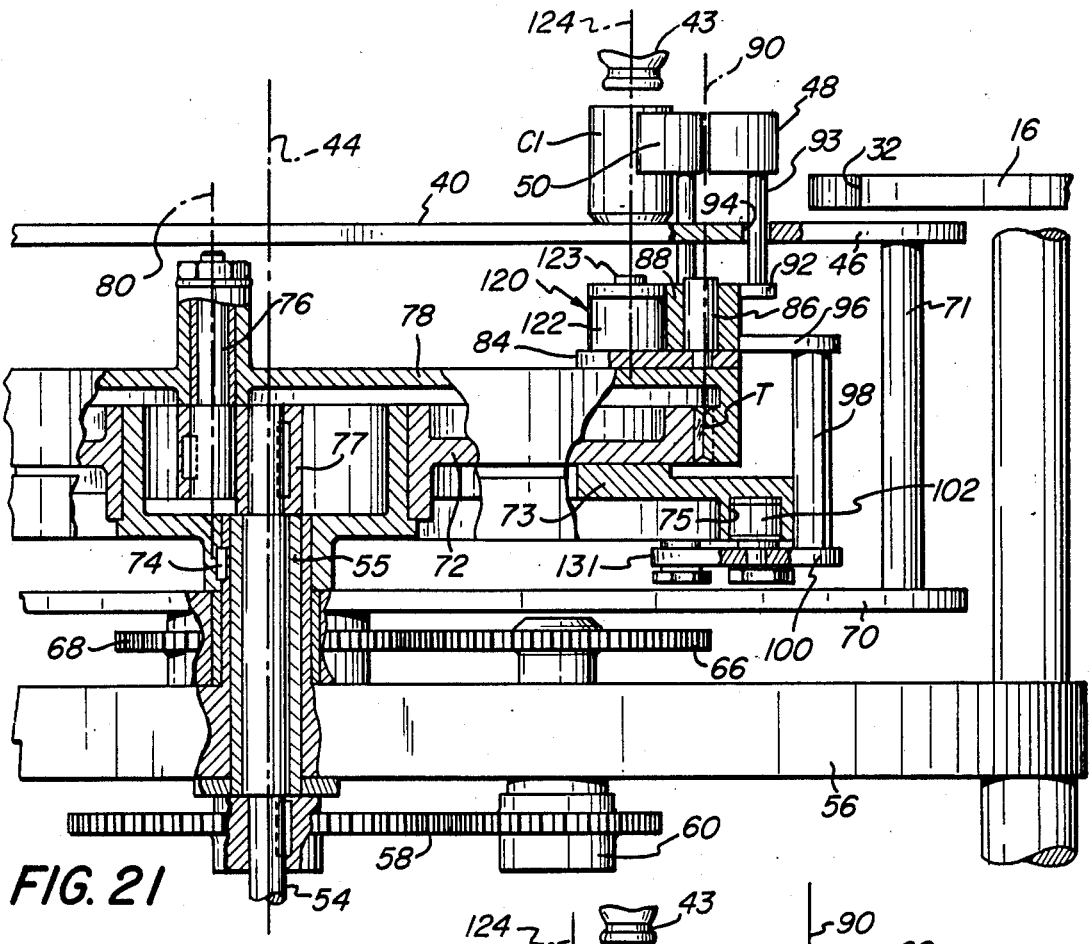
FIGS. 21 and 22 are fragmentary side elevational views of the apparatus showing the operating mechanism in its two extreme positions and having portions removed and broken away for purposes of illustration.
Figure 22:
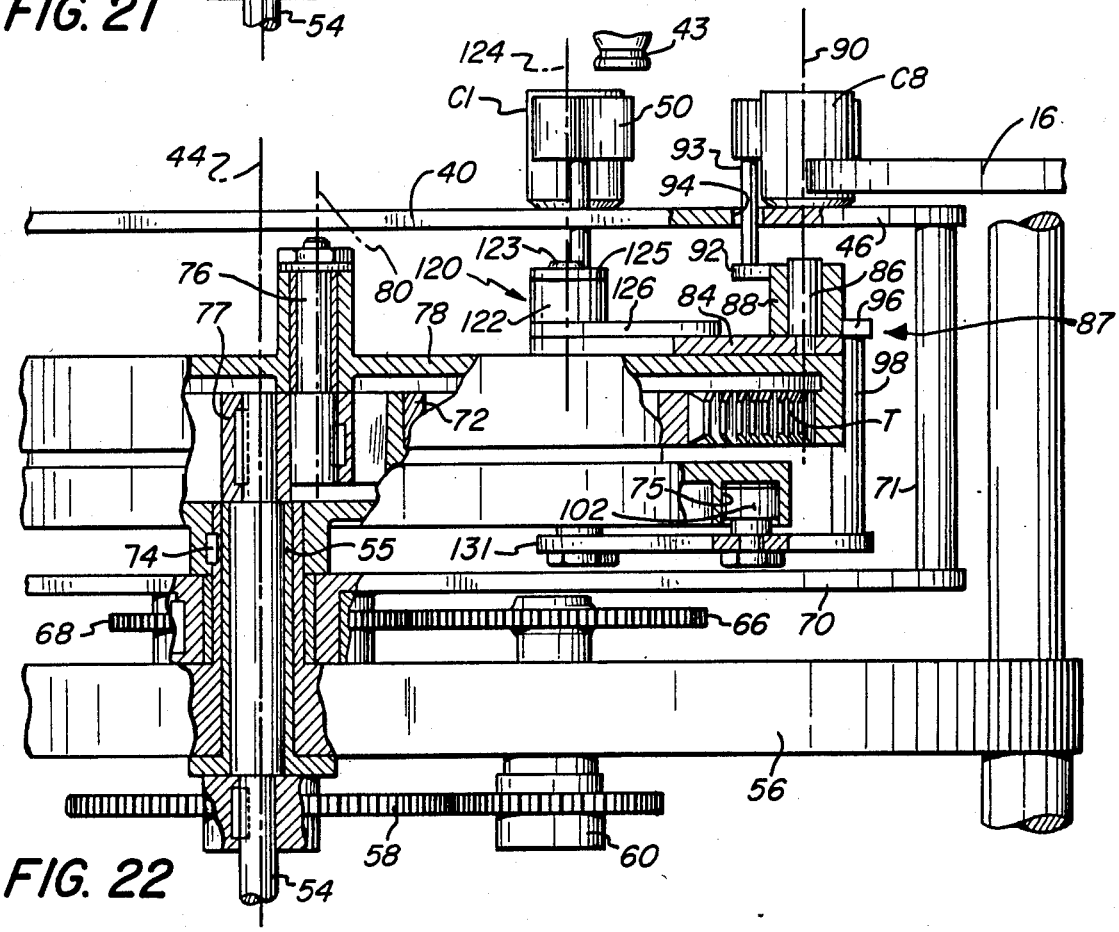

Turning now to FIGS. 21–22, the operating mechanism for oscillating and rotating the feeder and discharge guides can be more clearly understood. A main drive shaft 54 is journalled in a bearing 55 through a stationary machine frame 56 for rotation about the central axis 44 and is connected to a source of rotary power (not shown). Fixed to the drive shaft 54 is a gear 58 which meshes with a transfer gear 60. The gear 60 is operatively connected to an idler gear 66 on the upper side of the machine frame 56. The gear 66 meshes with a gear 68 secured to a drive plate 70. The drive plate 70 includes multiplicity of column rods 71 (only one shown) extending upwardly at the outer periphery thereof. The column rods 71 support the annular turntable 46 at the upper ends thereof whereby rotation of the drive shaft 54 operates the gear train (gears 58, 60, 66 and 68) to rotate the drive plate 70 and ultimately the annular turntable 46 through the column rods 71 at a desired angular speed.

The main drive shaft 54 and the bearing 55 within which it is journalled are disposed partially in and extend upwardly through central apertures within gear 68, plate 70 and a stationary gear 72. The stationary gear 72 is fixed to bearing 55 by key 74. The underside of the stationary gear 72 has an annular extension 73 which defines a circular cam track 75 spaced from the outer edge of the stationary gear 72. The terminal end of the drive shaft 54 has a bracket 77 thereon including an eccentrically located shaft 76.

An internal gear 78 is rotatably mounted on the shaft 76 for rotatable movement about shaft axis or center 80. The internal toothed portion of internal gear 78 is in meshing engagement with the stationary gear 72 (note tooth T in FIG. 21) so that any tooth on the internal gear 78 describes an epicycloidal path such as path 52 depicted in FIG. 2 when the center axis 80 of the internal gear 78 is rotated around the central axis 44.

Figure 34:
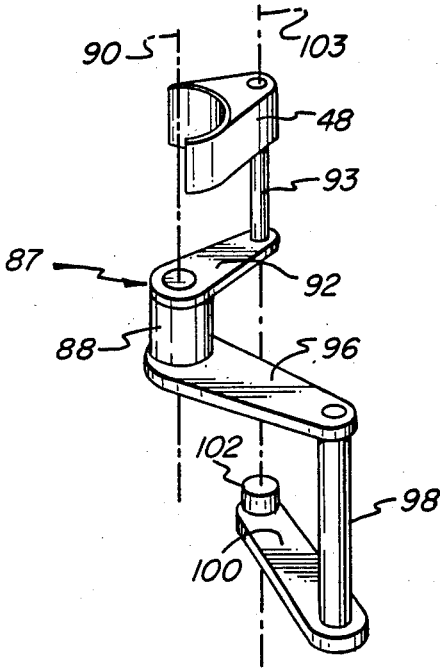
FIG. 34 is a perspective view of the feeder guide and its lever operating mechanism.

Rigidly mounted on the outer portion of the internal gear 78 is a plate 84 having a pin 86 extending upwardly therefrom and located on the pitch circle of the gear 78. Journalled on the pin 86 is a lever mechanism for the feeder guide 48 generally indicated by numeral 87 and including a bushing 88 rotatable about axis 90. As best seen in FIG. 34, the bushing 88 has an upper arm 92 extending outwardly therefrom with a support pin 93 mounted on the free end of the upper arm 92 passing upwardly through an annular space 94 (see FIGS. 21 and 22) between the deck plate 40 and the annular turntable 46. The bushing 88 includes a lower arm 96 cantilevered outwardly therefrom at an acute angle relative to the upper arm 92. Extending downwardly from the outer end of the lower arm 96 is a rod 98 which is secured to one end of an extension arm 100. The other end of the extension arm 100 includes a cam roller or follower 102 captured in the circular cam track 75 to ride freely therein (see FIGS. 21 and 22). It should be noted that the cam roller 102 and the support pin 93 are always aligned on axis 103 while the feeder guide 48 and the pin 86 are axially aligned about axis 90.

Figure 35:
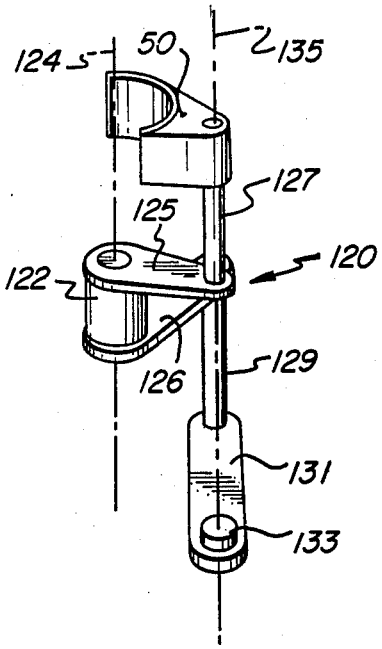
FIG. 35 is a perspective view of the discharge guide and its lever operating mechanism.

Referring to FIGS. 21–22 and 35, the discharge guide 50 is operatively connected to a lever mechanism generally indicated by the numeral 120. The mechanism 120 is similar to the mechanism 86 for the feeder guide 48 but is mounted by its bushing 122 on a support pin 123 for rotation about axis 124. Arms 125 and 126 extend at an acute angle relative to one another from opposite ends of the bushing 122 and supportively mount pins 127 and 129, respectively, at the outer ends thereof. The pin 129 has an extension arm 131 on the lower end thereof which carries cam roller 133. The cam roller 133 is axially aligned with the pin 127 on axis 135 captured in the cam track 75.

Figures 29, 30, 31:
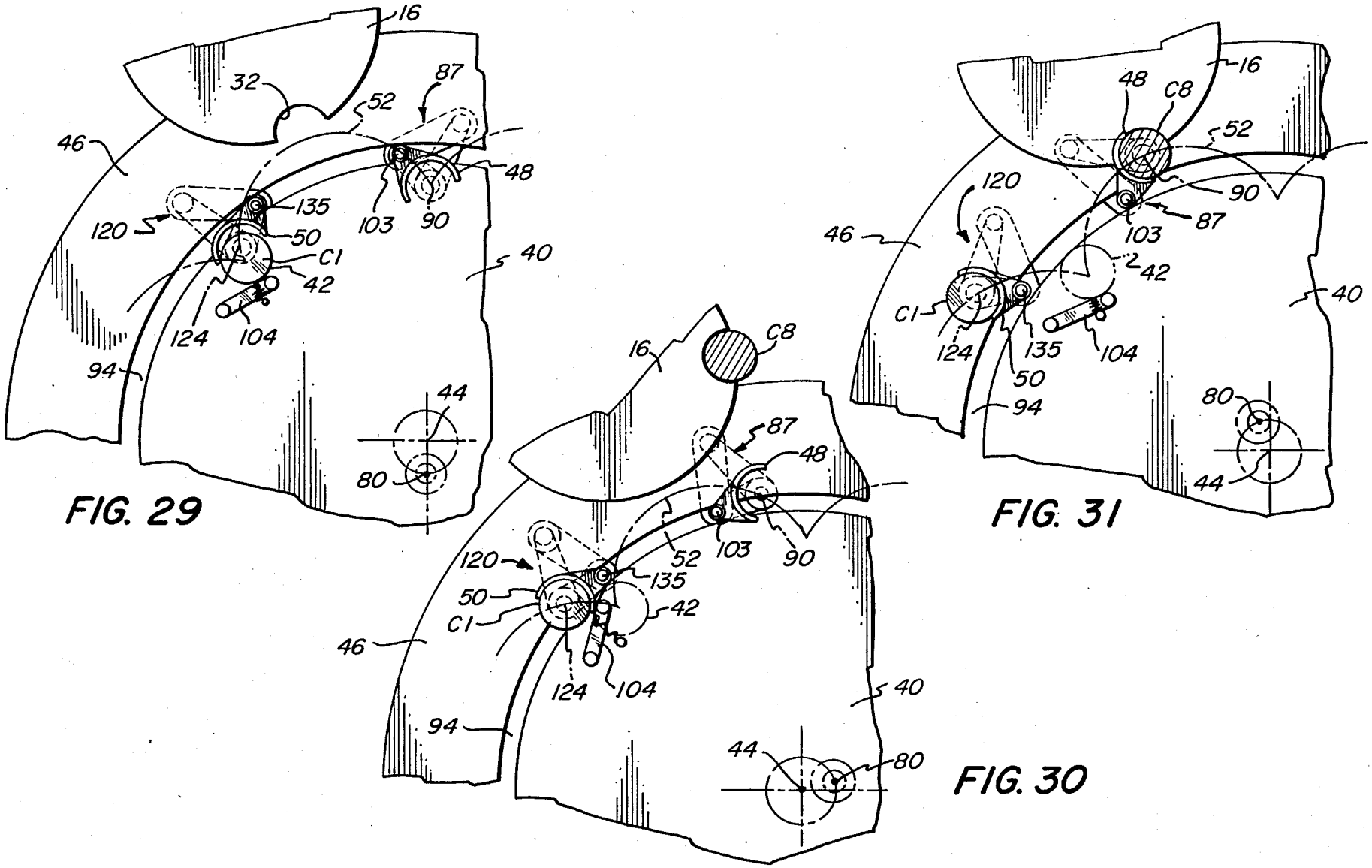
FIGS. 29–31 are schematic illustrations of the operation of the supply starwheel and the feeder and discharge guides.
Figure 32:
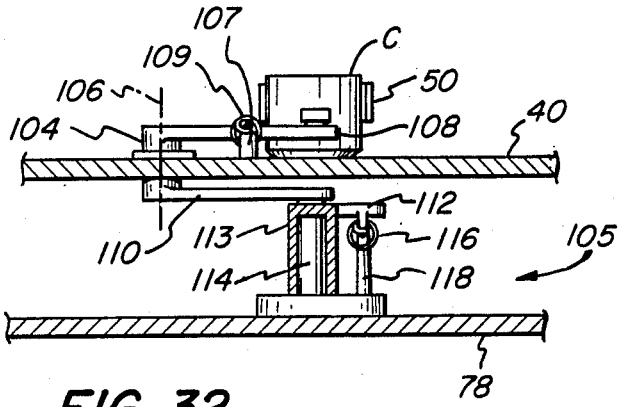
FIG. 32 is a fragmentary side elevational view of the apparatus with portions removed and broken away for clarity of illustration and showing the auxiliary discharge device cooperating with the discharge guide.

Referring now to FIGS. 29–31, in conjunction with FIGS. 34–35, axis 103 and thus pin 93 and cam roller 102 are on the leading or upstream side of the axis 103 as the feeder guide moves in a counterclockwise direction in the epicycloidal path 52. The support pin 123 of the mechanism 120 is located upstream of the axis 103. The lever mechanism 120 is mounted in reverse of the mechanism 87 whereby the axis 135 trails the axis 124 as discharge guide 50 moves in the counterclockwise direction in the epicycloidal path 52.

Referring now to FIGS. 23–28 and 32, therein depicted is an auxiliary discharge device generally indicated by the numeral 105. The auxiliary discharge device 105 includes a plurality of container contact portions 104 located adjacent the receiving stations 42 (see FIG. 1). Each of the portions 104 is mounted for pivotal movement about an axis 106 in the stationary deck plate 40 and has an upper lever arm 108 biased into an inactive position against stop member 107 by a coil tension spring 109. A lower lever arm 110 is attached to the upper lever arm 108 at an acute angle thereto. As will be explained further hereinafter, the upper lever arm 108 of each of the container contact portions 104 contacts the associated container C while the lower lever arm 110 cooperates with an actuator 112 which is mounted on the internal gear 78 for movement therewith. The actuator 112 with bushing 113 is pivotally mounted on shaft 114 and biased by a coil tension spring 116 against the stop member 118 to the position shown in FIG. 23.

Figure 2:
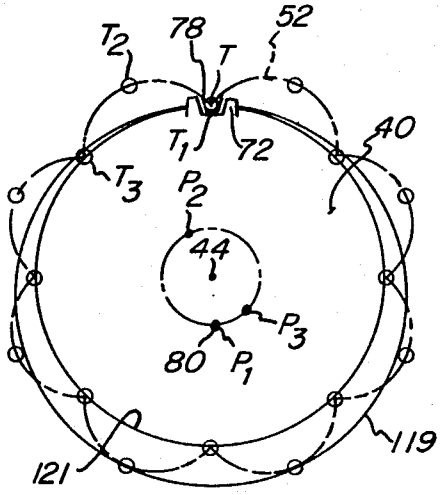
FIG. 2 is a diagrammatic illustration of the epicycloidal path described by tooth T on the internal gear about the stationary gear.
Figure 3:
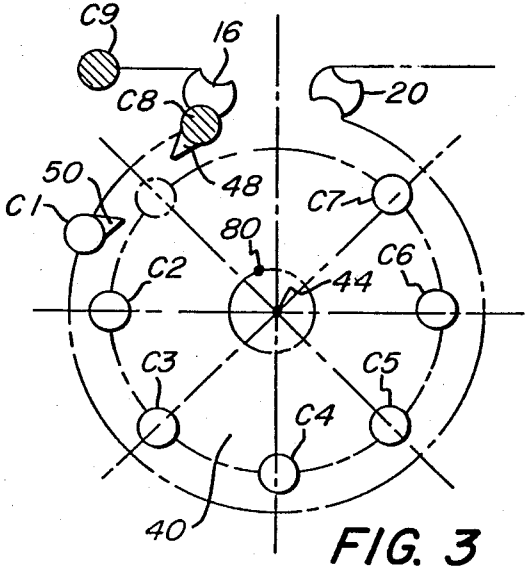
FIGS. 3–20 are schematic views illustrating the container placement apparatus in operation with the successive positions of the feeder guide and discharge guide corresponding to a successive turn of twenty-two and one-half degrees by the internal gear.
Figure 4:
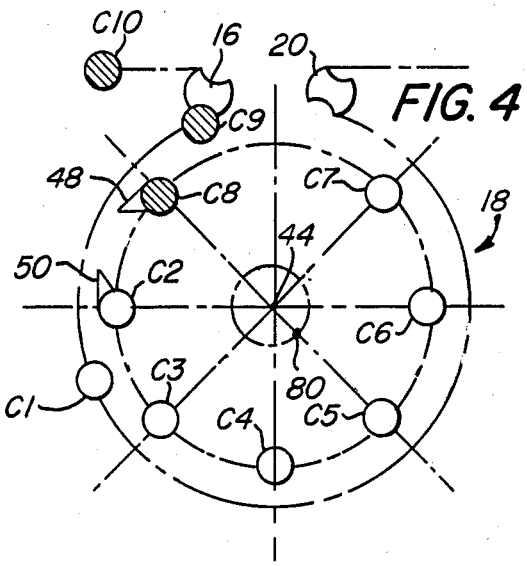
Figure 5:
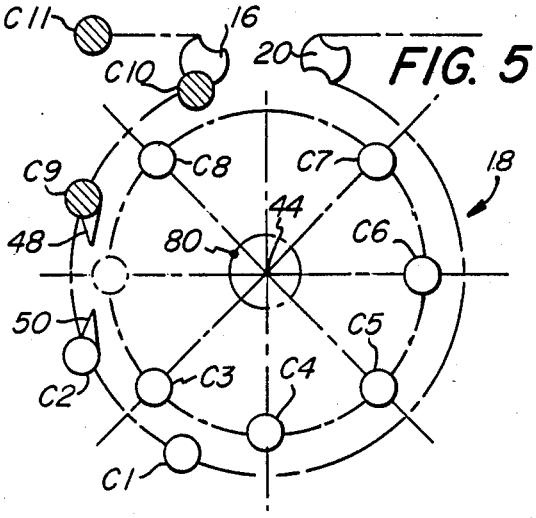
Figure 6:
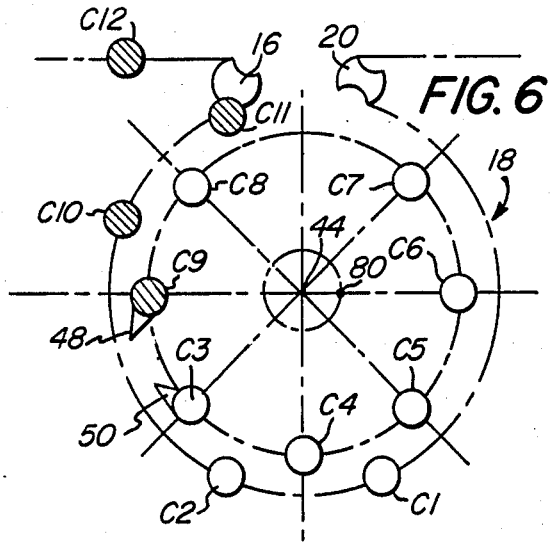
Figure 7:
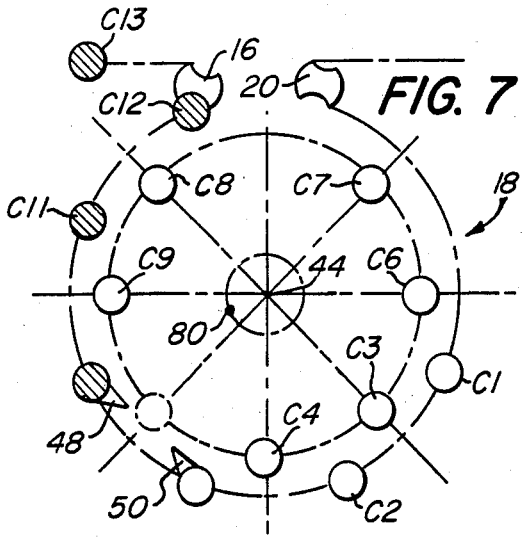
Figure 8:
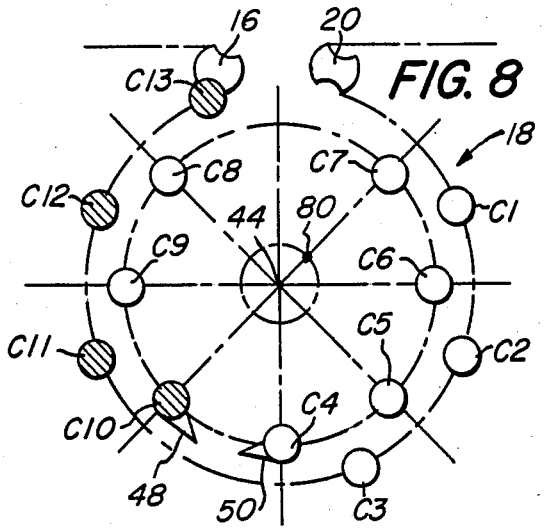
Figure 9:
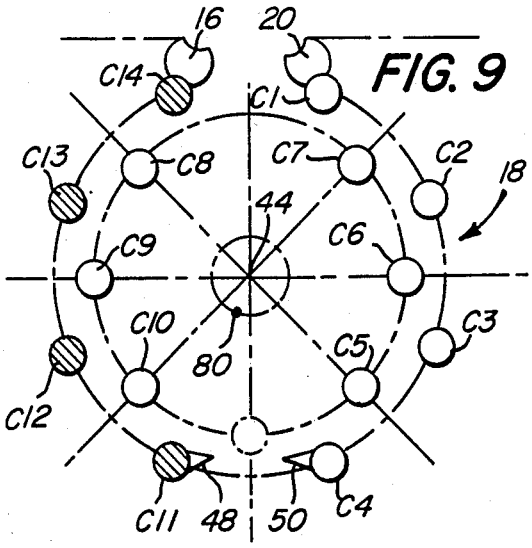
Figure 10:
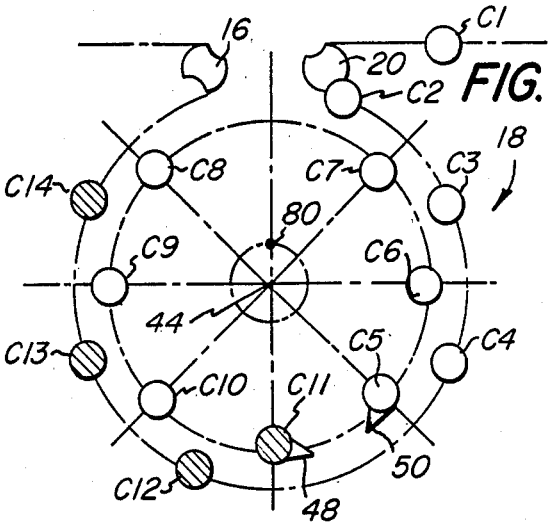
Figure 11:
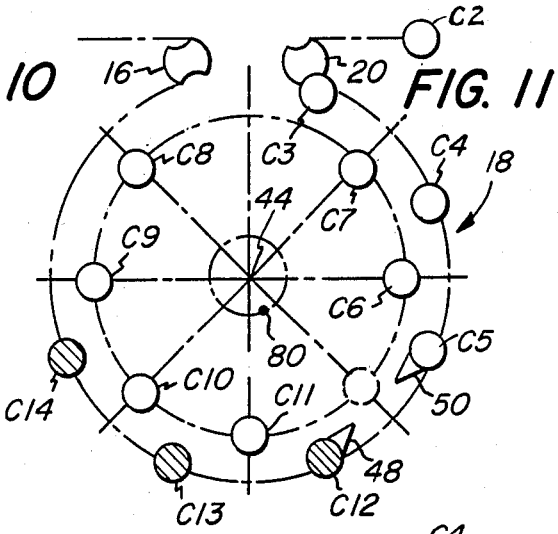
Figure 12:
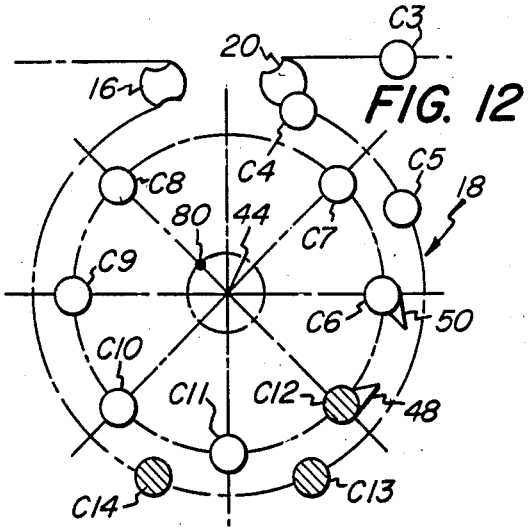

During normal operation of the machine starting from the machine position shown in FIGS. 1, 2 and 22, the main drive shaft 54 of the high speed placement apparatus 10 is rotated about central axis 44 thus swinging shaft 76 and internal gear 78 thereabout. Simultaneously, the gear train between the main drive shaft 54 and the drive plate 70 rotates the annular turntable 46 through column rods 71 at the desired angular speed. Meanwhile, the meshing relationship between the stationary gear 72 and internal gear 78 causes gear 78 to rotate about its axis 80. As illustrated in FIG. 2, the tooth T on the pitch circle 119 of internal gear 78 meshes with the teeth on the pitch circle 121 of stationary gear 72 at point T1 when the center 80 of gear 78 is located at point P1. The tooth T at point T1 is momentarily stationary. As the axis 80 continues to rotate around central axis 44 at a constant speed in the counterclockwise direction toward point P2, internal gear 78 is forced to rotate around its own axis 80 in the counterclockwise direction, and tooth T accelerates in a counterclockwise direction toward point T2, which is furthest away from the central axis 44, along the epicycloidal path 52 between T1 and T2. The speed of the tooth T is at its maximum speed at point T2. Continued counterclockwise rotation of the center 80 past points P2 and P1 and finally to point P3, decelerates the tooth T along the path 52 between T2 and T3 back into meshing contact with the stationary gear 72 at T3. Continued rotation of the main drive shaft 54 causes the tooth T to describe identical curves along the outer periphery of the stationary gear 72. The resulting path 52 is a perfect epicycloidal curve.

In the illustrated embodiment, the diameter of the stationary gear 72 is twelve inches with one hundred twenty teeth and the diameter of the internal gear 78 is thirteen and one-half inches with one hundred thirty-five teeth. Therefore, the distance between axes 44 and 80 is three quarters of an inch.

In normal operation, internal gear 78 rotates through an angle of forty degrees around its own axis 80 for each complete revolution of the axis 80 around axis 44. This is computed as follows:

135 (number of teeth on gear 78) − 120 (number of teeth on gear 72) = 15 (difference)

Difference/No. of teeth on gear 78 32
15/135 = 1/9 = 40/360

Therefore, axis 80 must make nine complete revolutions about axis 44 for internal gear 78 to make one complete revolution around gear 72.

The tooth T on internal gear 78 comes into contact with the stationary gear 72 once in every four hundred five degrees of the rotation of the axis 80 around axis 44. This is equal to one and one eighth turns around axis 44. Since a complete revolution of internal gear 78 requires nine turns of axis 80 around axis 44, the tooth T contacts with the stationary gear a total of eight times as shown in FIG. 2.

Referring again to FIGS. 29–31, the utilization of the epicycloidal motion of the internal gear 78 around the stationary gear 72 to oscillate the feeder guide 48 and discharge guide 50 can be more clearly understood. Referring first to the motion of the feeder guide 48, the axis 90 of pin 86 is located directly over the tooth T (see FIGS. 21–22) on the pitch circle of gear 78 and follows the epicycloidal path 52 illustrated in FIG. 2. As the pin 86 moves along the epicycloidal path 52, it forces the lever mechanism 87 to swing around the axis 103 since the cam roller 102 is captured in the cam track 75 and must follow the circular path defined thereby (see FIGS. 21–22). The angle over which the feeder guide 48 turns is determined by the arm length of upper arm 92 and in the embodiment herein depicted is ninety degrees so that the feeder guide 48 starts from a rest position adjacent the deck plate position between the starwheels 16 and 20 (FIG. 29) and swings outwardly (FIG. 30) in preparation to receive an empty container C8 from the starwheel 16 (FIG. 31) halfway between its travel to the receiving station 42.

Simultaneously with the movements performed by the feeder guide 48, the discharge guide 50, upstream thereof, performs a similar movement. In the embodiment shown, the axis 124 of pin 123 of the discharge guide is positioned on the pitch circle of the internal gear 78 spaced fifteen teeth upstream from the tooth T. Since the lever mechanism 120 is mounted in reverse of lever mechanism 87, the discharge guide 50 swings around the axis 124 to enable the discharge guide to to pick up a filled container from the stationary receiving station 42 (FIG. 29) and, with the assistance of the container contact portion 104 of the auxiliary discharge device 105, transfers the container radially outwardly (FIG. 30) onto the annular turntable 46 (FIG. 31) on which the container will continue to travel whilst the discharge guide 50 returns at a diminishing rate of speed to the next receiving station 42 to remove the associated filled container. It should be noted that the fifteen teeth spacing between the guides 48 and 50 causes the discharge guide 50 to lag slightly behind the feeder guide 48, e.g., the feeder guide 48 is in its stationary position in FIG. 29 while the discharge guide 50 is still approaching container C1 at weigh station 42.

Figure 23:
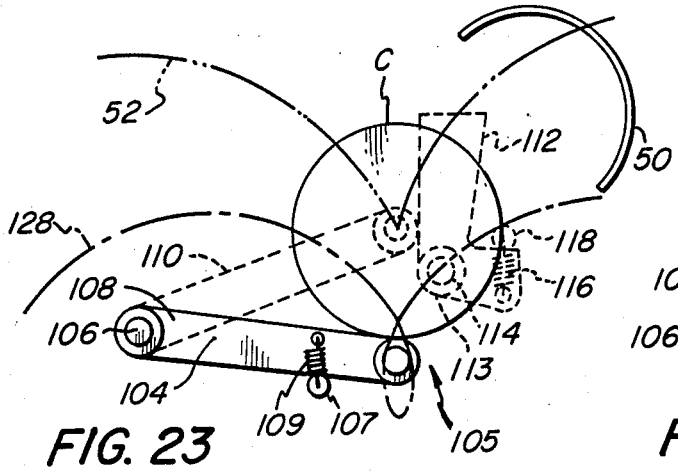
FIGS. 23–28 are schematic illustrations of the operation of the auxiliary discharge device in conjunction with the discharge guide.
Figure 24:
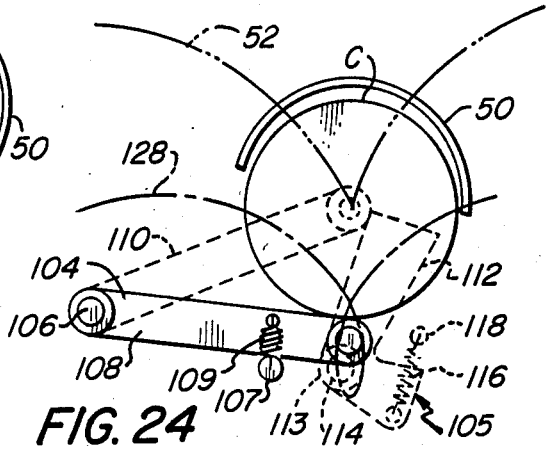
Figure 25:
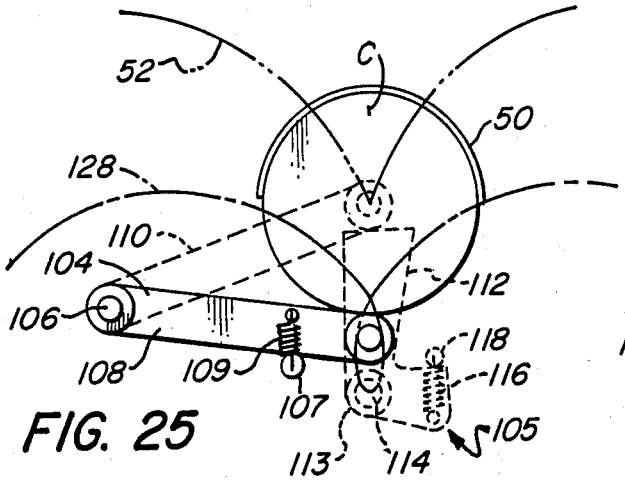
Figure 26:
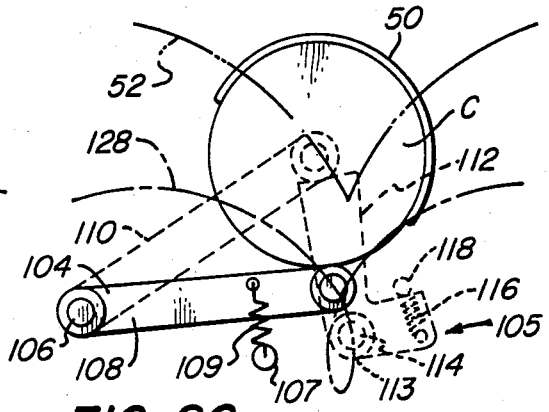
Figure 27:
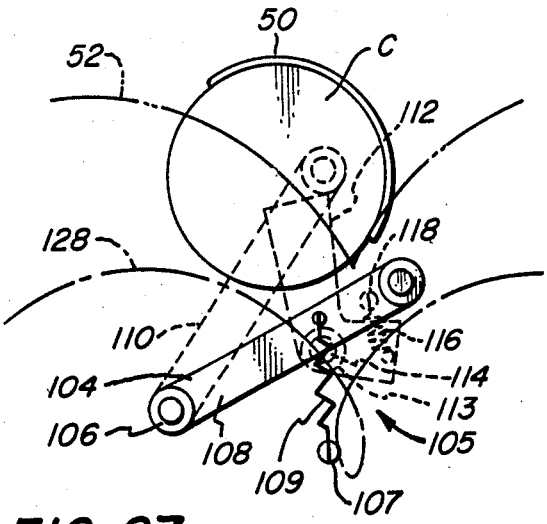
Figure 28:
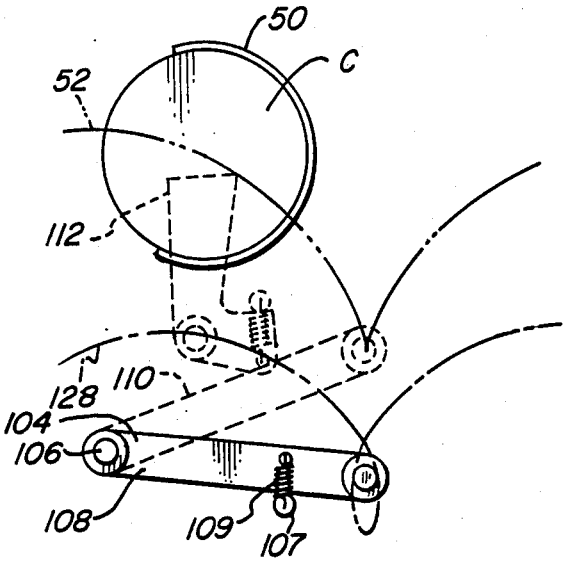

The operation of the auxiliary discharge device 105 is illustrated in FIGS. 23–28. Since points on the pitch circle of the gear 78 are describing epicycloidal curves, as its center axis 80 rotates around central axis 44, the pivot pin 114 spaced inwardly of the pitch circle on the gear 78 will traverse the curvilinear path indicated by numeral 128. In FIG. 23, the actuator 112 travelling with gear 78 initially engages the lower lever arm 110 of the container contact portion 104. Further movement of the gear 78 and the actuator 112 causes the actuator to pivot around the axis of the pivot pin 114 in the clockwise direction and against the bias of spring 116 (FIG. 24) until the actuator clears the lower arm 110 snapping back into the position shown in FIG. 25. The outer surface of the actuator 112 is then free to act upon the outer end of the lower lever arm 110 to enable the outer end of the upper lever arm 108 to cooperate with the discharge guide 50 and assist the transfer of the container C from the stationary receiving station 42 to the annular turntable 46 (FIGS. 26 and 30). As actuator 112 continues on the curvilinear path 128 as illustrated in FIGS. 27–28, the actuator 112 and the upper lever arm 108 disengage to allow the container contact portion 104 to return to original position under the influence of spring 109. It will be readily appreciated that the actuator 112 is mounted on the gear 78 adjacent discharge guide 50 and continues to follow the path 128. It performs its described function on each of the container contact portions 104 located adjacent each of the receiving stations 42 to cooperate with the discharge guide 50 in removing the containers therefrom.

Turning now to FIGS. 3–20 and again to FIG. 1, the high speed container placement apparatus 10 is diagrammatically illustrated in operation with the positions of the feeder guide 48 and discharge guide 50 shown in every turn of twenty-two and one-half degrees by gear 78 or, equivalently, a turn of two hundred two and one-half degrees of its axis 80 around axis 44.

As seen in FIG. 1, a group of seven containers C1–C7 is in sequence in the placement device 18 with one of the containers C1–C7 located in each of the receiving stations 42. Meanwhile, a second group of seven containers C8–C14 has been separated from the flooded delivery conveyor 12 by the clockwise rotation of the separating disk 24 utilizing cutouts 26. The rotation of the separating disk 24 is controlled by conventional means such as appropriate gearing to release groups of seven containers at the appropriate interval. The individual containers in the group C8–C14 are spaced by the timing screw 26 and moved along arcuate surface 36 by the supply starwheel 16 onto the rotating annular turntable 46 where they can be intercepted by the feed guide 48.

As the containers are delivered to the receiving stations 42, an appropriate load cell (now shown) associated with each receiving station 42 measures the initial weight of the container and controls filling of the containers with a flow of product from the associated dispensing device 43 until the desired product weight has been reached. The load cells are conventional and commercially available and sold trademark by Whitney Packaging-Processing Corporation located in Needham Heights, Mass. as their Model 0–8. The dispensing devices are also commercially available from Mateer-Burt, a division of Berwind Corporation located in Wayne, Pa. and sold under the Trademark "Neotron Systems". For very accurate control, the dispensing of the product can be slowed to a very low rate as the desired net weight is reached.

As illustrated in FIGS. 3–20, the feeder guide 48 and discharge guide 50 act in concert by continuing to move around the periphery of the stationary deck plate 40 moving group C1–C7 from the receiving stations 42 to the annular turntable 46 and replacing them with group C8–C14. A third group of containers C15–C21 begins its approach to the container placement and removal device 18 in FIGS. 22–24.

The speed of the annular turntable 46 and any containers thereon is at least equal to the speed of the feeder guide 48 at the moment the guide 48 picks up a container on the turntable and the speed of the discharge guide 50 at the moment the guide 50 places a container on the turntable 46. Since the speeds of the guides 48 and 50 at these moments is twice as fast as the average speed of gear 78, the annular turntable 46 has an angular speed at least twice as fast as the gear 78.

Figure 13:
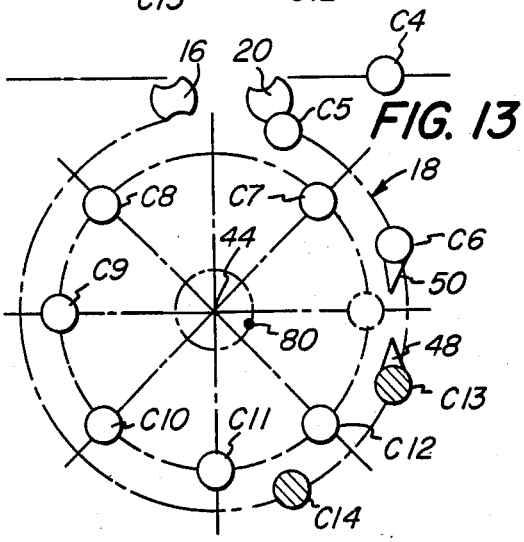
Figure 14:
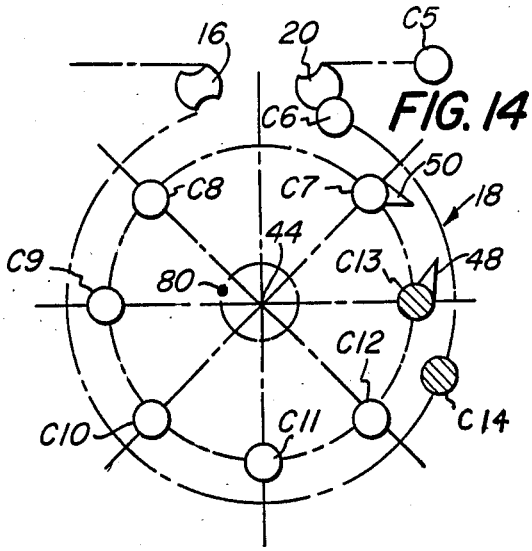
Figure 15:
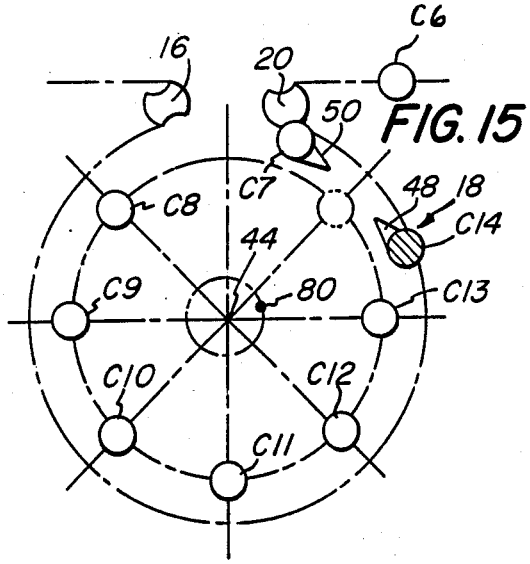
Figure 16:
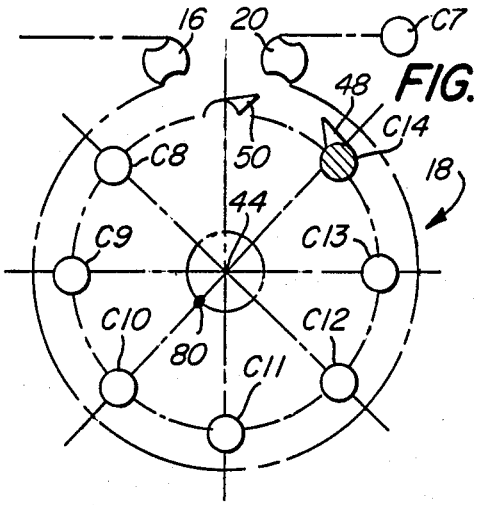
Figure 17:
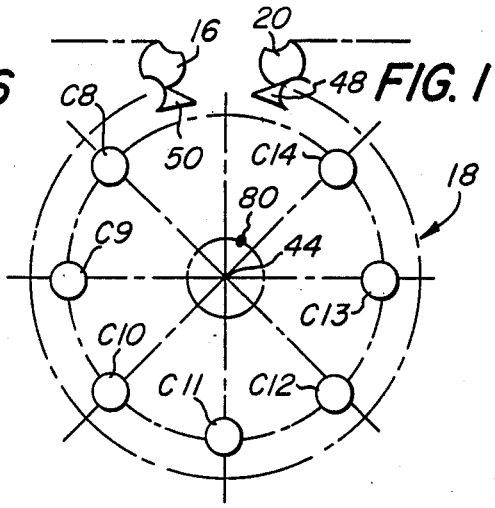
Figure 18:
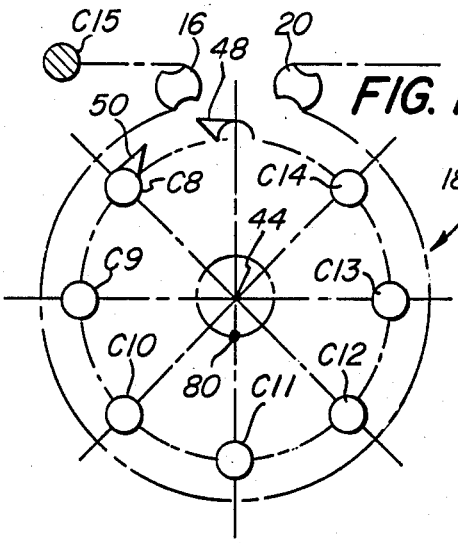
Figure 19:
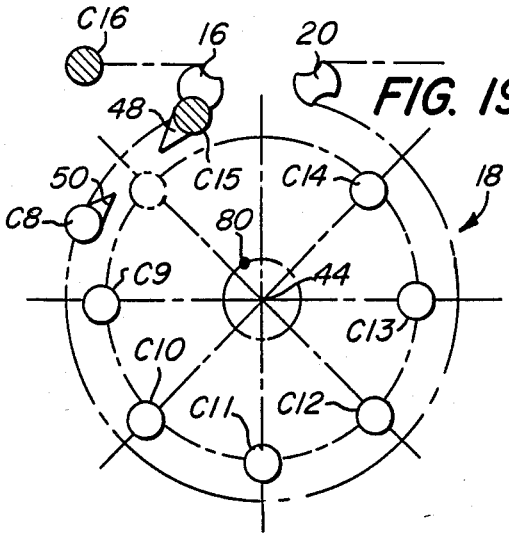
Figure 20:
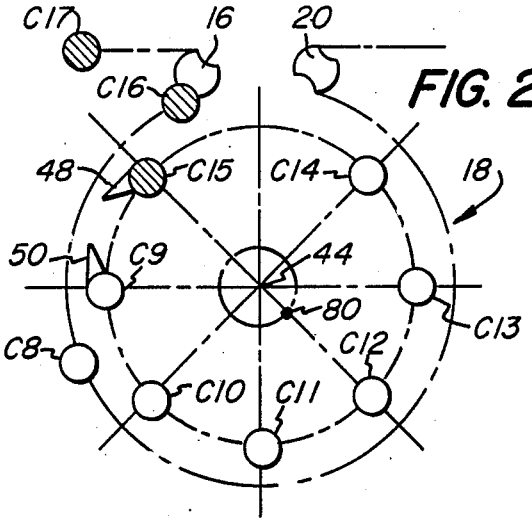

As illustrated in FIGS. 13–15, the exit starwheel 20 is timed to intercept the processed or filled containers, as they move on the turntable 46 and swing them along arcuate surface 38 onto exit conveyor 22 for further processing and/or packaging.

With seven positions used for receiving stations 42 in the normally eight position container placement and removal device 18 and with the guides 48 and 50 on gear 78 separated by an angle of 45°, a container in any of the seven positions is replaced after the gear 78 makes one revolution around its axis 80 of exactly three hundred sixty degrees. Since the axis 80 rotates nine times around axis 44 to replace a container in the same position, the replacement period of a container is, in this example, one ninth of one revolution of gear 78 and the rest period thereof is eight ninths of the time for one revolution.

With an assumed line speed of two hundred containers per minute, gear 78 has to rotate 200/7=28.6 times per minute. Center 80 rotates nine times faster or with 257 RPM. The time required for one rotation is 60/257=0.233 seconds or 1.86 seconds for each such rest period.

The relationship between the number of positions used on a unit 18, compared with the desired line speed, the resulting rest periods, etc. are as follows:

| | |
|---|---|
| Number of positions on unit | P |
| Number of positions used as receiving stations | P − 1 |
| Line speed (containers per minute) | LS |
| Gear ratio = gear 78/gear 72 = | $\frac{P+1}{P}$ |
| RPM of gear 78 = RPM G78 = | $\frac{LS}{P-1}$ |
| Time cycle for one revolution of gear 78 = 60/RPM G78 | $\frac{(P-1)\,60}{LS}$ |
| Time cycle for one revolution of axis 80 around axis 44 = | $\frac{60}{RPM\ G78} \times (P+1)$ |
| Time cycle for one revolution of axis 80 around axis 44 = | $\frac{60 \times (P-1)}{LS \times (P+1)}$ |
| Rest period = number of positions on unit × time cycle for one revolution = of gear 78 around gear 72 | $\frac{P \times 60\,(P-1)}{LS\,(P+1)}$ |

The following chart lists the rest period of containers with various sizes of units, based on different line speeds. As can be seen, relatively long rest periods can be obtained even on small units which operate at high line speeds. This will allow the time required for accurate dispensing of a product.

| POSITIONS ON UNIT | GEAR 78 / GEAR 72 GEAR RATIO | NUMBER OF PROCESSING STATIONS | LINE SPEED CONTAINERS/ MINUTE | RPM GEAR 78 | TIME CYCLE GEAR 78 IN SECONDS | RPM OF AXIS 80 AROUND AXIS 44 | TIME CYCLE OF AXIS 80 AROUND AXIS 44 IN SECS. | REST PERIOD IN SECONDS |
|---|---|---|---|---|---|---|---|---|
| 8 | 9/8 | 7 | 100 | 14.3 | 4.2 | 128.6 | 0.466 | 3.73 |
| | | | 200 | 28.6 | 2.1 | 257.1 | 0.233 | 1.86 |
| | | | 300 | 42.8 | 1.4 | 385.7 | 0.155 | 1.24 |
| | | | 400 | 57.1 | 1.05 | 514.3 | 0.117 | 0.94 |
| | | | 500 | 71.4 | 0.85 | 642.8 | 0.093 | 0.74 |
| | | | 600 | 85.7 | 0.70 | 771.4 | 0.077 | 0.62 |
| 12 | 13/12 | 11 | 100 | 9.1 | 6.6 | 118.2 | 0.507 | 6.08 |
| | | | 200 | 18.2 | 3.3 | 236.4 | 0.254 | 3.04 |
| | | | 300 | 27.2 | 2.2 | 354.5 | 0.169 | 2.03 |
| | | | 400 | 36.4 | 1.6 | 472.7 | 0.127 | 1.52 |
| | | | 500 | 45.5 | 1.3 | 591.0 | 0.101 | 1.22 |
| | | | 600 | 54.5 | 1.1 | 709.0 | 0.085 | 1.02 |
| 18 | 19/18 | 17 | 100 | 5.9 | 10.2 | 112 | 0.535 | 9.63 |
| | | | 200 | 11.8 | 5.1 | 224 | 0.267 | 4.81 |
| | | | 300 | 17.6 | 3.4 | 336 | 0.178 | 3.21 |
| | | | 400 | 23.5 | 2.5 | 448 | 0.134 | 2.41 |
| | | | 500 | 29.4 | 2.0 | 560 | 0.107 | 1.93 |
| | | | 600 | 35.3 | 1.7 | 672 | 0.089 | 1.60 |
| 24 | 25/24 | 23 | 100 | 4.3 | 14.0 | 107.5 | 0.56 | 13.4 |
| | | | 200 | 8.7 | 7.0 | 215. | 0.28 | 6.7 |
| | | | 300 | 13.0 | 4.6 | 322. | 0.18 | 4.5 |
| | | | 400 | 17.4 | 3.5 | 430. | 0.44 | 3.3 |
| | | | 500 | 21.7 | 2.8 | 537. | 0.11 | 2.7 |
| | | | 600 | 26.0 | 2.3 | 645. | 0.09 | 2.2 |

The difference between the diameters of gears 72 and 78 is governed by the number of receiving stations or positions on the apparatus 10 and the diameter of the containers being processed. For example, an eight-position machine with a diameter for gear 72 of twenty-four inches and diameter for gear 78 of twenty-seven inches, can handle containers not larger than three inches in diameter, i.e., the difference in diameter between the gears. If it is necessary to handle containers of double the diameter, i.e., six inches in diameter, the diameters of gears 72 and 78, and the size of the entire machine will have to be doubled.

Another way to accommodate large-sized containers is to reduce the eight-position machine to four positions, without changing the diameter of the gear 72 but increasing that of gear 78 to thirty inches. However, such a machine will have a reduced capacity since it has only four positions. To overcome this lack of capacity, the four-position machine can be transformed into an eight-position machine without changing the diameters of gears 72 and 78 by rotating 72 on an intermittent basis in a direction opposite to the direction of gear 78. Gear 78 would have to be stationary whenever the guides 48 and 50 are in contact with containers in their stationary position. However, gear 72 can move as soon as the guides 48 and 50 start to move. The speed would be generally proportional to the speeds of the guides 48 and 50 on gear 78. Therefore, the four-position machine will essentially be changed to an eight-position machine capable of handling the same large containers without increasing the overall size by providing eight forty-five degree intermittent, backward movements of gear 72 totalling to a full turn, during the time required to turn axis 80 ten times around axis 44 and gear 78 one full turn, during which its guides will come to a stop eight times. These intermittent backward motions of gear 72 can be accomplished by conventional means such as an intermittently driven servo motor.

To change the same machine into a twelve-position machine, gear 72 will have to make twelve intermittent background movements of thirty degrees each, totalling to a full turn, while gear 78 makes one revolution with twelve stops and axis 80 rotates fifteen times around axis 44.

Figure 33:
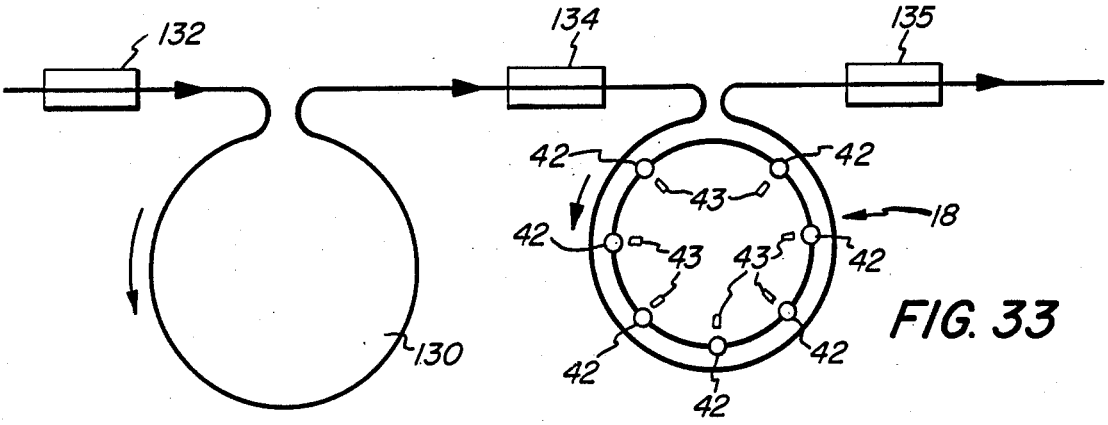
FIG. 33 is a schematic illustration of various arrangements of the present apparatus to provide initial bulk filling of containers and subsequent high accuracy top-off filling of the containers.

To achieve the desired filling accuracy in the rest periods indicated on the preceding chart, it is sometimes desirable to bulk fill the containers prior to their introduction into the high speed container apparatus 10. FIG. 33 diagrammatically illustrates various arrangements to provide an initial bulk filling step to obtain maximum accuracy in product net weight. The filling device has a bulk filler generally indicated by numeral 130 and three positions 132, 134 and 136 for check weighers. Such weighers are commercially available from Whitney Packaging-Processing Corporation, Needham, Mass. and are sold under the trademark "Datachek". When the containers are nonuniform weight, such as glass containers, the device can have a check weigher in position 132 and load cells at receiving stations 42. Each of the empty containers is weighed by the check weigher in position 132 and this information is relayed electronically to the load cell at receiving station 42 which will receive the same container and control the filling of the containers by weight. The empty containers are sent through the bulk filler 130 and filled by volume so that the containers merely have to be topped off with additional product at the receiving stations 42 by dispensing devices 43 to obtain the desired net weight. This top-off operation is effective to reduce the filling time and allows for very high speed operations.

Another arrangement is to replace the load cells of the previous example with a high speed check weigher at position 134. The partially filled containers coming from the bulk filler 130 are weighed by the check weigher in position 134 which relays the information to the respective dispensing devices to permit topping off of the partially filled containers.

Still another variation on this theme is the provision of another check weigher in position 136 to check the final net weight of the product as the containers leave the high speed placement device 18 of the previous example. The information generated by the check weigher in position 136 is used to automatically recalibrate the dispensing devices 43 on a continuous basis.

Thus, it can be seen from the foregoing detailed specification and attached drawings that the container placement apparatus of the present invention provides an effective means to decelerate a container from a high speed delivery conveyor, hold the container in a rest position for a predetermined amount of time, and accelerate the container back to high line speed.

It should be understood that the preferred embodiments have been described above for handling containers in a filling or dispensing apparatus and admirably achieve the objects of the invention; however, it will be appreciated that the present apparatus can be used to handle a variety of items or products and departures can be made by those skilled in the art without departing from the spirit and scope of the invention which is limited only by the following claims.

Having thus described the invention, what is claimed is:

1. A high speed container placement apparatus (A) a plurality of container receiving stations spaced equidistantly from a central axis;

(B) an annular turntable rotatable about said central axis;

(C) conveying means juxtaposed adjacent said turntable for introducing containers onto said turntable and removing containers therefrom; and (D) means to guide containers between said turntable and said plurality of container receiving stations, said guide means including oscillatable discharge and feeder guide members which follow a epicycloidal path around said central axis.

2. The high speed container placement apparatus in accordance with claim 1, wherein said guide means further includes a stationary gear coaxial with said central axis and having external teeth thereon being centered on said central axis, a main drive shaft journalled for rotation about said central axis, an internal gear mounted on said drive shaft for rotation about a center axis eccentrically spaced from said central axis, said internal gear being positioned around said stationary gear and being in meshing contact therewith, whereby rotation of said drive shaft swings said center axis and said internal gear about said central axis causing said internal gear to rotate around said center axis.

3. The high speed container placement apparatus in accordance with claim 2, wherein said guide means include lever mechanisms for said feeder and discharge guides rotatably mounted on said internal gear and operatively connected to said stationary gear, whereby rotation of said internal gear around said center axis permits said lever mechanisms to oscillate said feeder and discharge guides as said guides follow said epicycloidal path.

4. The high speed container placement apparatus in accordance with claim 3, wherein each of said lever mechanisms has a cam roller on a lower end thereof and said stationary gear has a circular cam track therein, whereby said cam rollers are captured for movement within said cam track.

5. The high speed container placement apparatus in accordance with claim 3, wherein each of said lever mechanisms includes a bushing rotatably retained on said internal gear, an upper arm cantilevered from one end of said bushing, a lower arm extending from the other end of said bushing at an acute angle to said upper arm, and means on said lower arm operatively connected to said stationary gear to oscillate said lever mechanism as said internal gear rotates around said center axis.

6. The high speed container placement apparatus in accordance with claim 2, wherein said main drive shaft is provided with a gear train for driving said annular turntable at a desired speed.

7. The high speed container placement apparatus in accordance with claim 1, wherein said conveying means includes a container delivery and separating means for introducing groups of containers onto said annular turntable for placement by said guide means onto said receiving stations.

8. The high speed container placement apparatus in accordance with claim 7, wherein said delivery and separating means includes a timing screw having a helical groove with axially expanding turns for spacing adjacent containers.

9. The high speed container placement apparatus in accordance with claim 8, wherein said delivery and separating means includes a rotatable starwheel adjacent said turntable and a terminal end of said timing screw whereby containers exiting from said timing screw are intercepted by said starwheel and transferred to said turntable.

10. The high speed container placement apparatus in accordance with claim 1, further including an auxiliary discharge device to assist said discharge guide member in guiding said containers from said receiving stations to said turntable.

11. The high speed container placement apparatus in accordance with claim 10, wherein said auxiliary discharge device has a plurality of container contacting portions adjacent each of said container receiving stations and an actuator associated with said discharge guide to contact individual ones of said contacting portions to assist said discharge guide to transfer an associated container from one of said receiving stations to said turntable.

12. The high speed container placement apparatus in accordance with claim 2, further including an auxiliary discharge device to assist said discharge guide member in guiding said containers from said receiving stations to said turntable.

13. The high speed container placement apparatus in accordance with claim 12, wherein said auxiliary discharge device has a container contacting portion associated with each of said container receiving stations and an actuator mounted on said internal ring gear to permit operative engagement with individual ones of said container contacting portions to assist said discharge guide to transfer an associated container from one of said receiving stations to said turntable.

14. The high speed container placement apparatus in accordance with claim 13, wherein said container contact portions are pivotally mounted adjacent said container receiving stations and have a container contacting arm and an actuator contacting arm extending at an acute angle relative to one another.

15. The high speed container placement apparatus in accordance with claim 1, wherein said container receiving stations are weigh stations with product dispensing devices for filling said containers by product weight.

16. A high speed placement device for use with workpieces such as containers comprising:

(A) a plurality of workpiece receiving stations spaced equidistantly from a central axis;

(B) an annular turntable rotatable about said central axis for transporting workpieces thereon;

(C) feeder guide means for transferring workpieces from said turntable to said workpiece receiving stations;

(D) discharge guide means for transferring workpieces from said workpiece receiving stations to said turntable; and (E) means to oscillate said feeder and discharge guide means to transfer said workpieces between said turntable and said workpiece receiving stations.

17. The high speed placement device in accordance with claim 16, wherein said feeder and discharge guide means follow an epicycloidal path around said central axis and said feeder guide means is downstream of said discharge guide means.

18. The high speed container placement apparatus in accordance with claim 16, wherein said guide means further includes a stationary gear being coaxial with said central axis and having external teeth thereon being centered on said central axis, a main drive shaft journalled for rotation about said central axis, an internal gear mounted on said drive shaft for rotation about a center axis eccentrically spaced from said central axis, said internal gear being positioned around said stationary gear and being in meshing contact therewith, whereby rotation of said drive shaft swings said center axis and said internal gear about said central axis causing said internal gear to rotate around said center axis.

19. The high speed container placement apparatus in accordance with claim 18, wherein said guide means include lever mechanisms for said feeder and discharge guides rotatably mounted on said internal gear and operatively connected to said stationary gear, whereby rotation of said internal gear around said center axis permits said lever mechanisms to oscillate said feeder and discharge guides as said guides follow said epicycloidal path.

20. The high speed container placement apparatus in accordance with claim 19, wherein each of said lever mechanisms has a cam roller on a lower end thereof and said stationary gear has a circular cam track therein, whereby said cam rollers are captured for movement within said cam track.

21. The high speed container placement apparatus in accordance with claim 19, wherein each of said lever mechanisms includes a bushing rotatably retained on said internal ring gear, an upper arm cantilevered from one end of said bushing, a lower arm extending from the other end of said bushing at an acute angle to said upper arm, and means on said lower arm operatively connected to said stationary gear to oscillate said lever mechanism as said internal gear rotates around said center axis.

22. The high speed container placement apparatus in accordance with claim 16, further including an auxiliary discharge device to assist said discharge guide member in guiding said containers from said receiving stations to said turntable.

23. The high speed container placement apparatus in accordance with claim 22, wherein said auxiliary discharge device has a container contacting portion adjacent each of said container receiving stations and an actuator associated with said discharge guide to contact individual ones of said contacting portions to assist said discharge guide to transfer an associated container from one of said receiving stations to said turntable.

24. The high speed container placement apparatus in accordance with claim 18, further including an auxiliary discharge device to assist said discharge guide member in guiding said containers from said receiving stations to said turntable.

25. The high speed container placement apparatus in accordance with claim 24, wherein said auxiliary discharge device has a plurality of container contacting portion associated with each of said container receiving stations and an actuator mounted on said internal ring gear to permit operative engagement with individual ones of said container contacting portions to assist said discharge guide to transfer an associated container from one of said receiving stations to said turntable.

26. The high speed container placement apparatus in accordance with claim 25, wherein said container contact portions are pivotally mounted adjacent said container receiving stations and have a container contacting arm and an actuator contacting arm extending at an acute angle relative to one another.

27. The high speed container placement apparatus in accordance with claim 16, wherein said workpieces are containers and said receiving stations are weigh stations with product dispensing devices for filling said containers by weight.

* * * * *